US010087587B2

(12) United States Patent
Neumann et al.

(10) Patent No.: US 10,087,587 B2
(45) Date of Patent: Oct. 2, 2018

(54) ARTICULATING ROLLING COMPACTOR ATTACHMENT

(71) Applicant: Road Widener LLC, Oconomowoc, WI (US)

(72) Inventors: Duane A. Neumann, Jefferson, WI (US); Devin Wolf, Oconomowoc, WI (US); Michael Schutte, Ixonia, WI (US)

(73) Assignee: Road Widener LLC, Oconomowoc, WI (US)

( * ) Notice: Subject to any disclaimer, the term of this patent is extended or adjusted under 35 U.S.C. 154(b) by 0 days.

(21) Appl. No.: 15/319,543

(22) PCT Filed: Dec. 22, 2015

(86) PCT No.: PCT/US2015/067483

§ 371 (c)(1),
(2) Date: Dec. 16, 2016

(87) PCT Pub. No.: WO2016/106369

PCT Pub. Date: Jun. 30, 2016

(65) Prior Publication Data

US 2017/0284035 A1 Oct. 5, 2017

Related U.S. Application Data

(60) Provisional application No. 62/096,001, filed on Dec. 23, 2014.

(51) Int. Cl.
*E01C 19/26* (2006.01)

(52) U.S. Cl.
CPC ..... *E01C 19/266* (2013.01); *E01C 19/268* (2013.01); *E01C 19/26* (2013.01)

(58) Field of Classification Search
CPC ..... E01C 19/266; E01C 19/268; E01C 19/22; E01C 19/26; E01H 5/06; E01H 5/04
See application file for complete search history.

(56) References Cited

U.S. PATENT DOCUMENTS 2,386,025 A * 10/1945 Wills ..... E01C 19/266 172/810
3,291,013 A * 12/1966 Stolp ..... E01C 19/27 404/128
3,394,641 A * 7/1968 Steck ..... E01C 19/26 404/122
4,193,710 A * 3/1980 Pietrowski ..... E01C 19/266 172/518

(Continued)

*Primary Examiner* — Abigail A Risic
(74) *Attorney, Agent, or Firm* — Boyle Fredrickson, S.C.

(57) ABSTRACT

A skid steer rolling compactor attachment may include a universal attachment plate configured to attach to the skid steer. A boom extending from the attachment plate may pivot about at least one articulating hinge attached to the boom. The boom may be configured to move a roller to compact a ground surface as the skid steer travels in a forward direction. In order to prevent roll-overs on uneven surfaces, the skid steer may be operated on a level surface and articulate the boom such that the roller contacts the ground parallel to the direction of travel. The skid steer may then compact inclined surfaces while travelling on level surfaces thus improving worker safety.

20 Claims, 6 Drawing Sheets

(56) References Cited

U.S. PATENT DOCUMENTS

| | | | | |
|---|---|---|---|---|
| 5,395,182 | A * | 3/1995 | Rossburger | E01C 19/27 404/122 |
| 6,345,932 | B1 * | 2/2002 | Fix | B62D 12/00 180/419 |
| 6,612,774 | B1 * | 9/2003 | Dulin | E01C 19/266 404/104 |
| 7,540,689 | B1 * | 6/2009 | Major, Sr. | E01C 19/266 172/611 |
| 2007/0206993 | A1 * | 9/2007 | Tyhy | E01C 19/26 404/128 |
| 2008/0069639 | A1 * | 3/2008 | James | E01H 1/003 404/104 |
| 2008/0267719 | A1 * | 10/2008 | Corcoran | E01C 19/266 405/271 |
| 2010/0135724 | A1 * | 6/2010 | Roth | E01C 19/235 404/124 |
| 2010/0278589 | A1 * | 11/2010 | Verhoff | E01C 19/268 404/104 |
| 2012/0045281 | A1 * | 2/2012 | Wagner | B62D 12/00 404/117 |
| 2013/0306338 | A1 * | 11/2013 | Wood, Sr. | E01C 19/268 172/548 |
| 2017/0167087 | A1 * | 6/2017 | Frelich | E01C 19/235 |

* cited by examiner

ARTICULATING ROLLING COMPACTOR ATTACHMENT

CROSS REFERENCE TO PREVIOUS APPLICATION

This application is a U.S. National Stage of and claims priority from international application PCT/US2015/067483 filed Dec. 23, 2015 which claims priority to U.S. Provisional Application Ser. No. 62/096,001 filed on Dec. 23, 2014, which are hereby incorporated herein by reference in their entirety.

BACKGROUND OF THE INVENTION

Devices for road widening and creating shoulders are known in the road construction industry. During construction of roads and shoulders, the soil must be compacted in order to prevent settling. Soil compaction is relatively straight-forward on level surfaces, however; inclined surfaces present can be difficult to properly compact as the compactor may become unstable and topple and/or slide.

Another feature of known devices is that they are self-propelled. Many of the devices include large engines with transmissions for moving the device. Some examples include drivable, rolling compactors. These devices add considerable transportation issues and costs to the project.

Additionally, the shoulder of a roadway often includes a pitch or slope away from the road. This slope helps drainage and ensures a safer roadway. The further the distance from the roadway, the steeper the pitch may be. There may also be hills to the side of a road with an increasing grade that requires compaction. In order to provide a proper foundation for the road, the entire shoulder and surrounding area need to be properly compacted.

Due to the positive or negative slope, conventional compaction equipment like the above-mentioned rolling compactors is known to topple and roll over. This can cause bodily harm and even death as compaction equipment varies in weight from a hundred pounds to thousands of pounds. It can also be expensive to transport and operate large equipment What is therefore needed in the road construction industry is a low-cost device that may be pushed by another vehicle such as a skid steer, thus eliminating the need for an engine and drivetrain. Also needed is a device that can compact the sloped shoulders of a roadway without the risk of tipping the vehicle. Another feature needed is a device that is constructed in a lightweight design, allowing for easier mobility, repairs, reduced costs, lower fuel consumption, and less maintenance.

SUMMARY AND OBJECTS OF THE INVENTION

A skid steer rolling compactor attachment may be formed from a universal attachment plate configured to attach to the skid steer. A boom may extending from the attachment plate and articulate/move in a plurality of axis with at least one hinge. The hinge(s) may allow a roller attached to the boom opposite the attachment plate to compact a ground surface to the side of the skid steer as the skid steer travels forward.

The skid steer rolling compactor attachment may further include a boom attached to the skid steer with at least one articulating hinge. The articulating hinge may be configured to allow the boom to articulate in at least one axis. A roller may be attached to the boom opposite the articulating hinge.

The skid steer may be driven forward, or in any direction of travel. In order to compact the ground to the side of the skid steer, the roller may be moved to a side of the skid steer perpendicular to the direction of travel. The roller may then be lowered to contact a ground surface perpendicular to the direction of travel. The ground surface may then be compacted on the side of the skid steer as the skid steer is driven forward.

The invention may include one or more of the characteristics discussed above in various combinations, thus, allowing for a reduced labor time and labor effort when compacting ground on a job site. These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
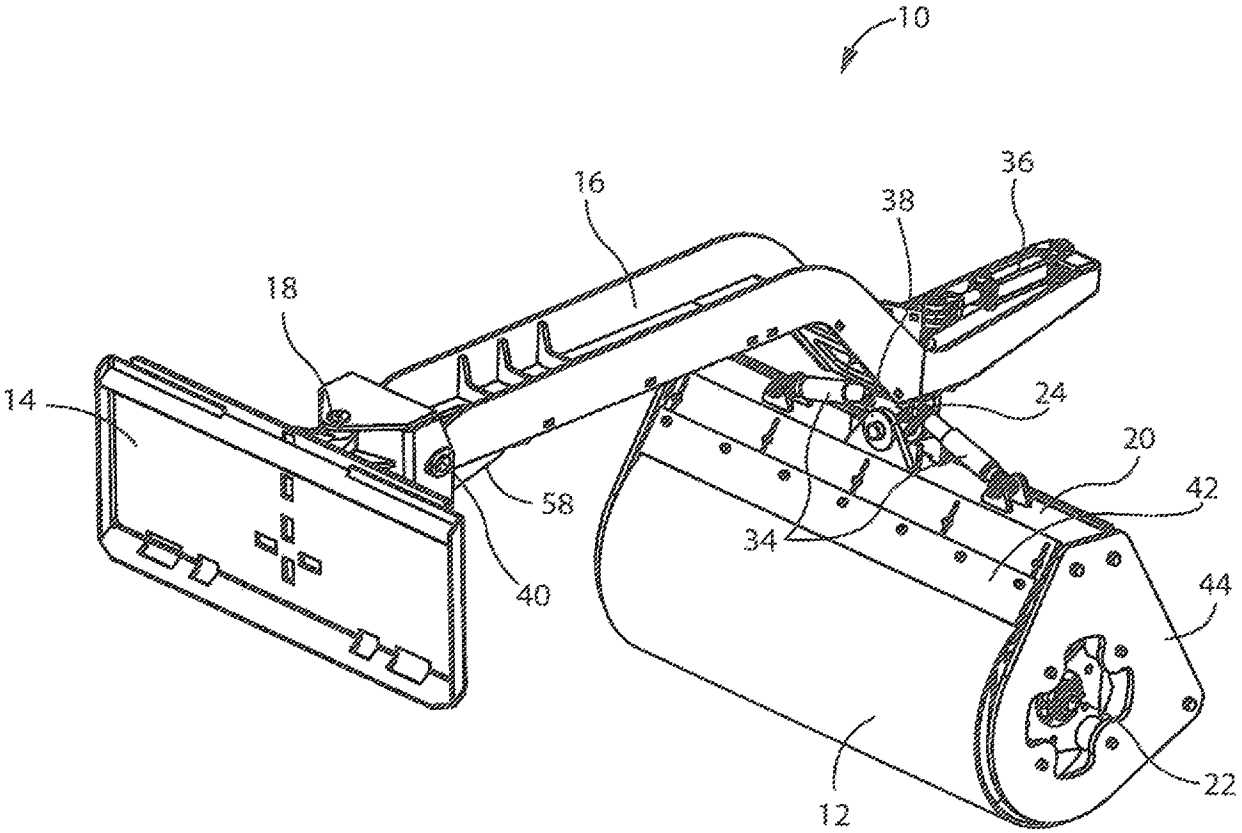
FIG. 1 illustrates a perspective right side view of the inventive articulating rolling compactor attachment device.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the words "connected", "attached", or terms similar thereto are often used. They are not limited to direct connection but include connection through other elements where such connection is recognized as being equivalent by those skilled in the art.

DETAILED DESCRIPTION OF EMBODIMENTS

Skid steers are commonly used in construction sites as the power source for a number of attachments. As they are commonly used to move aggregate, dirt, or other debris, they are typically present during road construction. Skid steers are also considerably less expensive than other earth-moving construction equipment and for this reason they are preferable for use in road construction. For example, there are many ways to move a mound of gravel. In order to minimize costs and maximize profits companies routinely seek the most efficient way to get things done. In this example, a skid steer is typically the most economical way to move the gravel. An added benefit of the skid steer is that there are a number of attachments that can be attached to the skid steer. As a result, a single skid steer can be configured to perform the tasks of a number of different earth-moving equipment.

Figure 2:
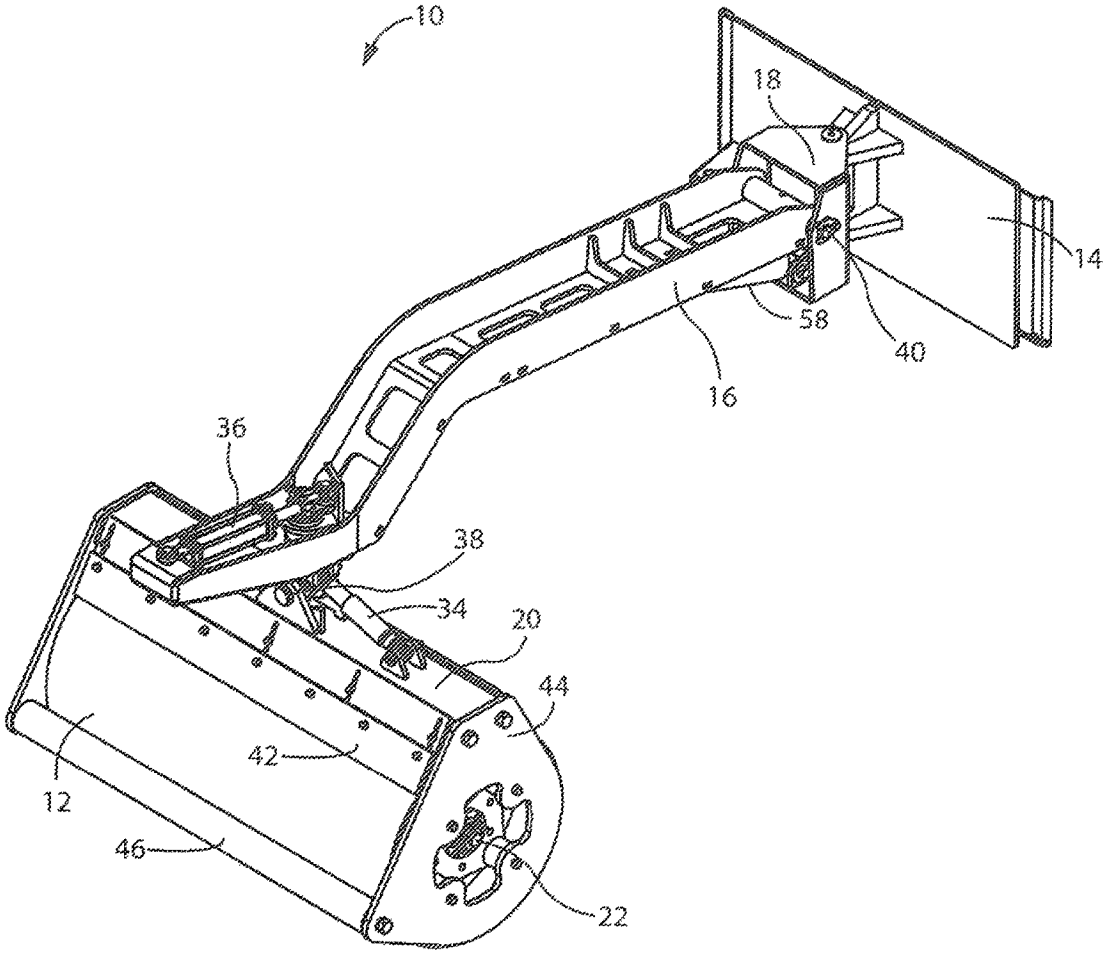
FIG. 2 illustrates a perspective left side view of the inventive articulating rolling compactor attachment device of FIG. 1.

The inventive skid steer attachment is shown in FIGS. 1-6. The articulating rolling compactor attachment 10 is configured for attachment to a skid steer 26 as specifically shown in FIGS. 6A and 6B. Referring to FIGS. 1 and 2, the attachment plate 14 may include any number of holes, bosses, fittings, or any other attachment device to connect to a skid steer. The attachment plate 14 is preferably constructed of a resilient material such as steel, but any other known material may be used. In order to provide a universal compatibility, the attachment plate 14 preferably has more than one attachment device so that it can attach to any number of unique skid steers 26. Alternatively, the attachment plate may connect to any vehicle, not just skid steers 26.

Regardless of the propulsion vehicle, the articulating rolling compactor attachment 10 may have independent controls that allow operation totally independent from the host vehicle. In such a configuration, the boom 16 may be operated to extend, pivot, spin, rotate, or articulate in any direction. It is to be understood that pivot, twist, spin, turn, and the like all mean movement in any direction with respect to not only the boom but any part of the invention. The movement is not to be limited to only a certain type of movement in one axis but complete freedom of motion in all directions. Preferably the boom 16 will be hydraulically operated with an independent hydraulic assembly, but it may tap into the existing hydraulics of the host vehicle. Also, electronic actuators may be used to provide articulation power. A joystick or lever controller may also be employed to articulate the boom 16, weather independent or pre-existing on the host vehicle.

In the preferred embodiment, the boom 16 is attached to the attachment plate 14 about a pivot hinge 18 and a lift hinge 40. A lift cylinder 58 may be actuated from within the skid steer 26 to raise and lower the boom 16. A pivot cylinder 52, seen for example in FIG. 3, may also be actuated to cause the boom 16 to pivot about the pivot hinge 18.

On the opposing side of the boom, opposite the attachment plate 14, the roller 12 may twist about a twist hinge 24 with the use of a twist cylinder 36. The twist cylinder 36 is attached to the boom 16 and causes the roller 12 to twist about the twist hinge 24 when actuated. This twisting motion allows the roller 12 to be properly oriented alongside the skid steer so that it can properly compact the ground to the side of the skid steer.

An added joint may be included proximate the twist hinge 24 such as a tilt hinge 38. The tilt hinge 38 connects a frame 20 that supports the roller 12 to the boom 16. When a tilt cylinder 34 is actuated, it causes the frame 20 to tilt in one direction or the other. For added stability, a tilt cylinder 34 is attached to the frame 20 on each side of the boom 16. The tilt hinge 38 thus allows the roller 12 to pivot about the horizontal axis. The roller 12 is therefore allowed to pivot which enables compaction along an inclined slope as the skid steer 26 is driven forward along the adjacent level road. In this configuration, the skid steer 26 never needs to come in contact with the incline and can remain on the level road which promotes safety.

As previously mentioned, the roller 12 may also be suspended from the boom 16 by a frame 20. The frame 20 may cradle the roller 12 and attach to its central axis with bearings 22. The bearings 22 allow the roller 12 to roll without binding on the boom 16. While the roller 12 is rolling about the bearings 22, an adjustable scraper 42 may be included on each side of the roller 12. The adjustable scrapers 42 attach to the frame 20 and are positioned to scrape off any debris stuck onto the roller 12 as it rotates. A side plate 44 may also be attached on each side of the roller 12 to the frame 20 which protect the sides of the roller 12. A guide 46 may further stiffen the side plates 44 to provide structural rigidity to the frame 20.

Figure 3:
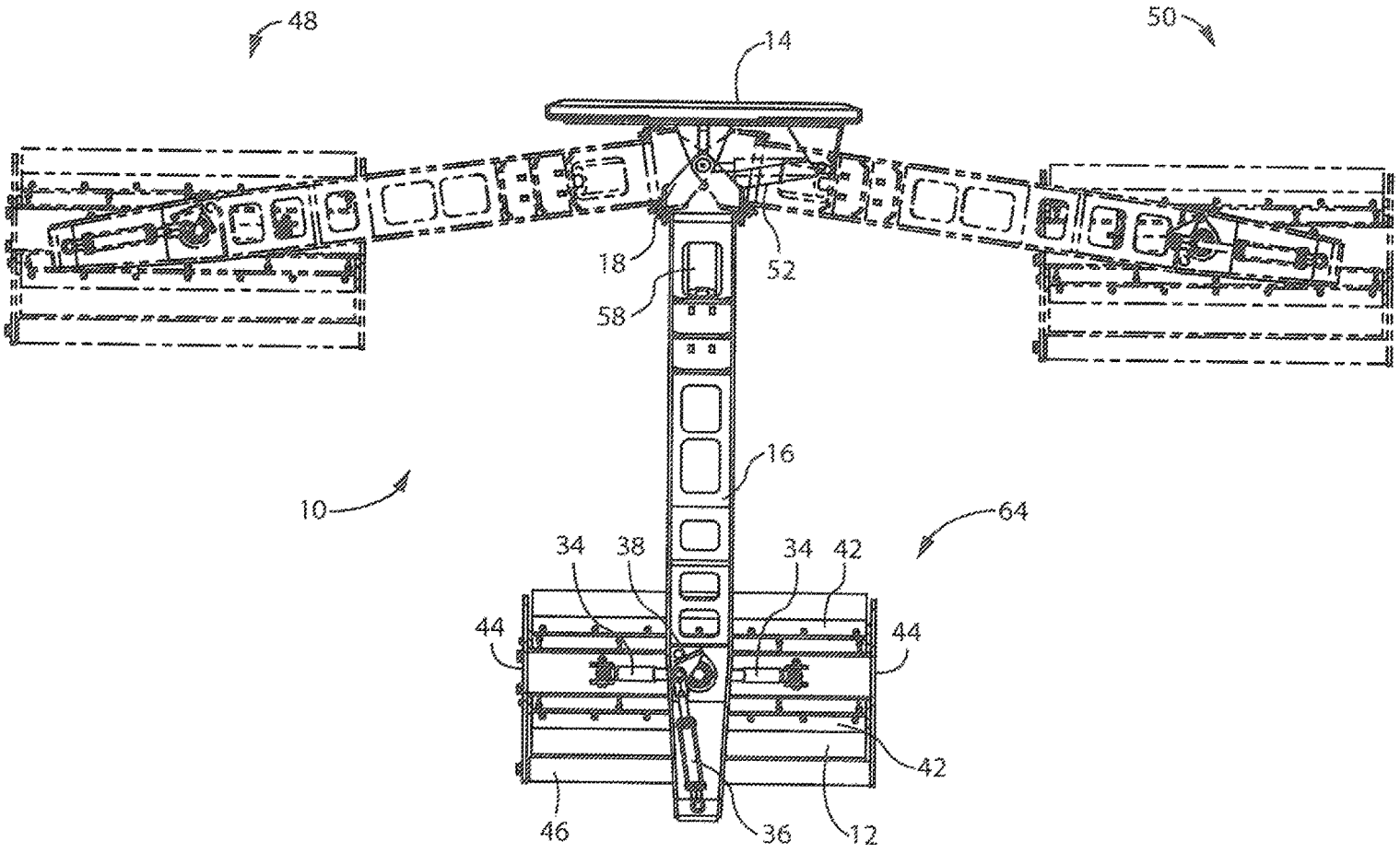
FIG. 3 illustrates a top view of the articulating rolling compactor attachment of FIG. 1 with the boom articulating side to side in various positions shown in ghost images.

Referring now to FIG. 3, when pivoting the boom 16 about the pivot hinge 18, the boom 16 may pivot to a fully turned right position 48, a centered position 64, and to a fully turned left position 50. The boom 16 may also be pivoted anywhere in between the respective fully turned positions. The pivot hinge 18 joins the boom 16 to the attachment plate and is powered by a pivot cylinder 52 which may be remotely actuated from within the skid steer 26. Regardless of the amount of articulating hinges, and regardless of the specific location of each hinge, the roller 12 may be placed in any desired location and oriented in any desired manner. This articulation allows the roller 12 to be placed above the host vehicle and also to the side of the vehicle. Similarly, the articulation allows the roller to be placed below the host vehicle and to the side.

Figure 4:
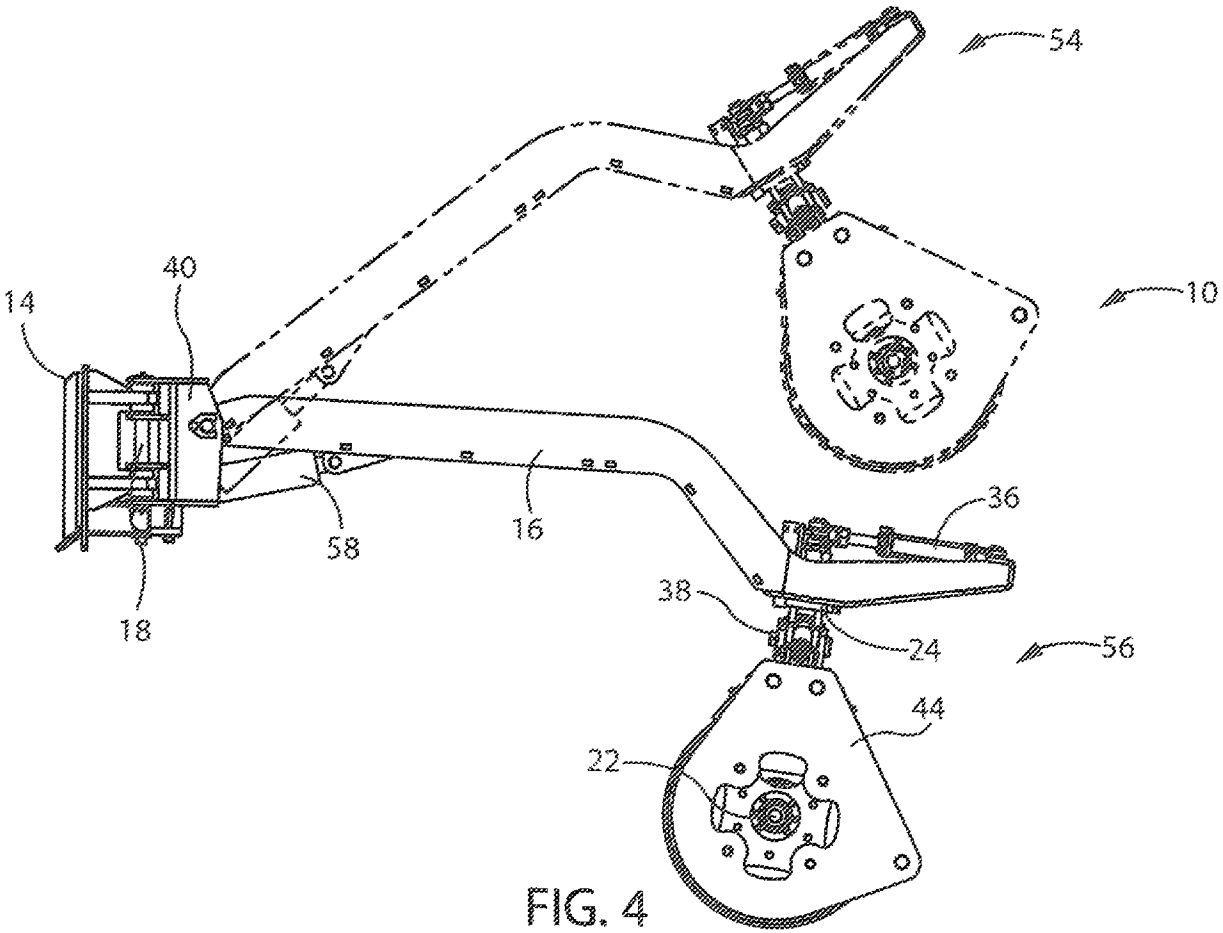
FIG. 4 illustrates a side view of the articulating rolling compactor attachment of FIG. 1 with the boom articulating up and down in various positions shown in ghost images.

As shown in FIG. 4, the boom 16 may also be lifted and lowered about the lift hinge 40 with a lift cylinder 58. The boom 16 may be raised to a fully raised position 54 and lowered to a fully lowered position 56 through remote actuation of the lift cylinder 58. This articulation allows for proper placement of the articulating rolling compactor attachment 10 on a sloped surface while keeping the skid steer 26 on a safe and level road.

Figure 5:
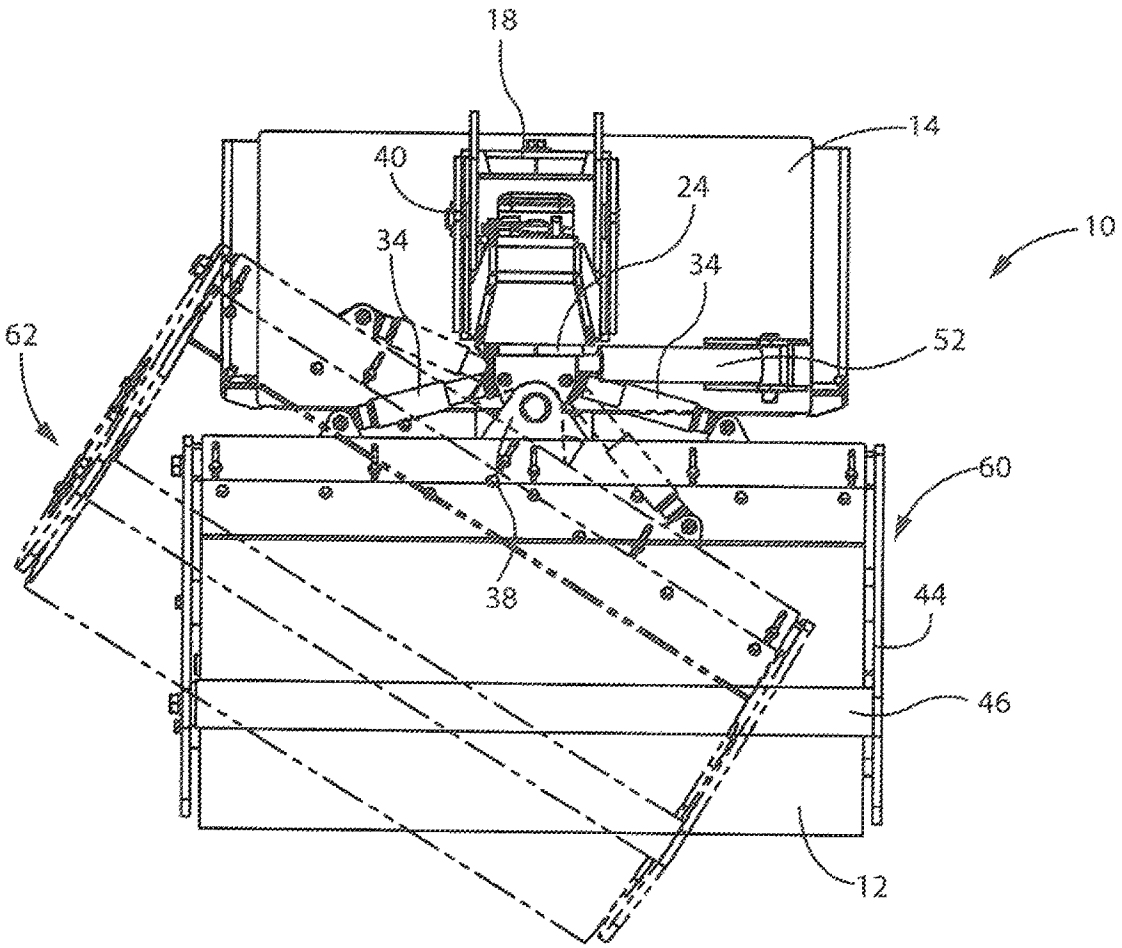
FIG. 5 illustrates a front view of the articulating rolling compactor attachment of FIG. 1 with the roller pivoting in a ghost image.

Moving on to FIG. 5, the articulating rolling compactor attachment 10 may be operated by actuating the tilt cylinders 34 such that the frame 20 and the supported roller 16 is tilted from a centered position 60 to a fully tilted position 62. While the roller 12 is shown tilted in a ghost image in only one direction, the plurality of tilt cylinders 34 allow the frame to tilt about the tilt hinge 38 in either direction. As previously discussed, this articulation allows for proper placement of the articulating rolling compactor attachment 10 on a sloped surface while keeping the skid steer 26 on a safe and level road.

Figure 6A:
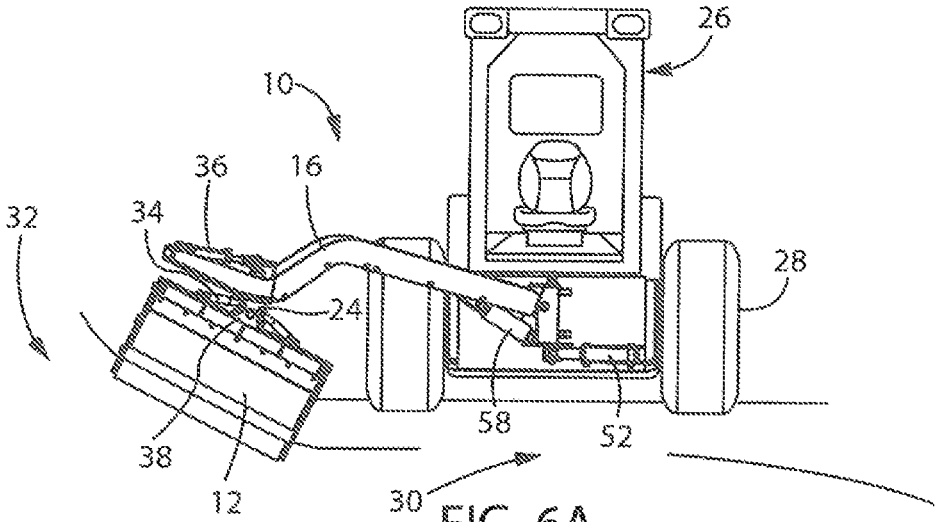
FIG. 6A illustrates a rear view of a skid steer with the articulating rolling compactor attachment of FIG. 1 attached and in operation.
Figure 6B:
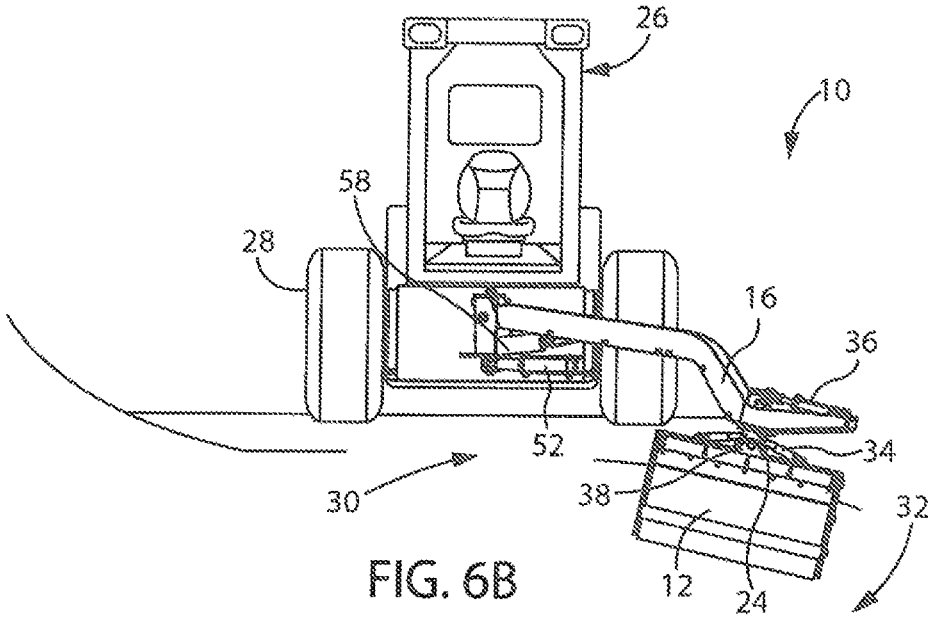
FIG. 6B illustrates a rear view of a skid steer with the articulating rolling compactor attachment of FIG. 1 attached and in operation.

As is shown in FIGS. 6A and 6B, the boom 16 may be articulated to place the roller 12 to the side of the skid steer 26 to compact the ground on the included slope 32 and eliminate the danger of a roll-over. Known rolling compactors would normally be driven directly on the inclined slope 32 and thus be prone to toppling over and causing injury to workers. Skid steer attachment devices also require the skid steer to be driven on the inclined surface.

FIG. 6A indicates an inclined slope 32 with a positive incline, the boom 16 may also articulate for a negative slope as shown in FIG. 6B or centered for a level road 30. The inventive articulating rolling compactor 10 may pivot the boom 16 about the pivot hinge 18 such that it is at an approximately 90 degrees to the front portion of the skid steer 26. The roller 12 may then be twisted about the twist hinge 24 to place the central, longitudinal axis of the roller, or the bearing 22 axis perpendicular to the side of the skid steer 26 as is shown. In this orientation the roller 12 may be in contact with the inclined slope 32 to the side of the skid steer 26 while the skid steer 26 is driven on the level road 30 in a forward direction. An additional benefit is that the wheels 28, or tracks, of the skid steer 26 may remain in contact with the relatively flat and level road 30 while compacting the inclined slope 32 to the side. The skid steer 26 may then drive forward and parallel to the inclined slope 32 while compacting at the same time.

The roller 12 may include any known compaction roller such as a water-filled drum. Alternatively, the roller may include a vibration system within the drum. The boom 16 may also be adjusted such that a predetermined amount of pressure is applied to the inclined slope 32 ensuring adequate compaction with minimal strain on the boom 16. Monitoring the pressure also ensures that the downward force from the boom 16 does not cause the skid steer 26 to topple. It is also envisioned that counterweights or ballast may be added to the skid steer 26 to further inhibit toppling.

It is also envisioned that the articulating rolling compactor 10 can be attached to any vehicle, not just a skid steer 26. For example, it is envisioned that the articulating rolling compactor 10 may be attached to a traditional drivable rolling compactor allowing the operator to compact the level road 30 surface and the inclined slope 32 at the same time.

Although the best mode contemplated by the inventor of carrying out the present invention is disclosed above, practice of the present invention is not limited thereto. It will be manifest that various additions, modifications, and rearrangements of the features of the present invention may be made without deviating from the spirit and scope of the underlying inventive concept. Moreover, the individual components need not be formed in the disclosed shapes, or assembled in the disclosed configuration, but could be provided in virtually any shape and assembled in virtually any configuration. Furthermore, all the disclosed features of each disclosed embodiment can be combined with, or substituted for, the disclosed features of every other disclosed embodiment except where such features are mutually exclusive.

It is intended that the appended claims cover all such additions, modifications, and rearrangements. Expedient embodiments of the present invention are differentiated by the appended claims.

What is claimed is:

1. A skid steer rolling compactor attachment comprising:
an attachment plate configured to attach to the skid steer;
a boom configured to attach to the attachment plate;
a pivot hinge disposed between the attachment plate and the boom and configured to allow the boom to pivot about a vertical axis;
a lift hinge disposed between the attachment plate and the boom and configured to allow the boom to lift about a horizontal axis;
a roller attached to the boom opposite the attachment plate configured to compact a ground surface;
a tilt hinge joining the roller to the boom configured to tilt the roller with respect to a level road; and
a twist hinge configured to twist the roller about a vertical axis.

2. The skid steer rolling compactor attachment according to claim 1, further comprising: an adjustable scraper extending a length of the roller configured to scrape a debris off of the roller as the roller revolves about a bearing.

3. The skid steer rolling compactor attachment according to claim 1, further comprising a hydraulic lift cylinder attached to the attachment plate and the boom configured to lift and lower the boom about the lift hinge.

4. The skid steer rolling compactor attachment according to claim 1, further comprising:
a frame attached to the boom supporting the roller; and
a hydraulic twist cylinder attached to the frame and the boom configured to twist the roller about the twist hinge.

5. The skid steer rolling compactor attachment according to claim 1, further comprising:
a frame attached to the boom supporting the roller; and
a hydraulic tilt cylinder attached to the frame and the boom configured to tilt the roller about the tilt hinge.

6. The skid steer rolling compactor attachment according to claim 1, further comprising a frame attached to the boom supporting the roller, wherein the frame is coupled to a central axis of the roller by way of at least one bearing.

7. The skid steer rolling compactor attachment according to claim 1, further comprising a pivot lift cylinder attached to the attachment plate and the boom configured to pivot the boom about the pivot hinge.

8. The skid steer rolling compactor attachment according to claim 1, wherein the lift hinge is configured to allow the boom to lift about the horizontal axis between a fully raised position and a fully lowered position, wherein the fully raised position places the roller above the skid steer, and wherein the fully lowered position places the roller below the skid steer.

9. A skid steer rolling compactor attachment comprising:
an attachment plate configured to attach to the skid steer;
a pivot hinge attached to the attachment plate;
a lift hinge attached to the attachment plate;
a boom attached to the attachment plate by way of the pivot hinge and the lift hinge, wherein the boom is configured to move about the pivot hinge in a horizontal direction, and wherein the boom is configured to move about the lift hinge in a vertical direction;
a twist hinge attached to the boom opposite the attachment plate;
a tilt hinge attached to the boom opposite the attachment plate;
a roller attached to the twist hinge and configured to twist in a horizontal direction about the twist hinge and the roller attached to the tilt hinge and configured to tilt in a vertical direction about the tilt hinge; and
wherein the roller is configured to compact a ground surface.

10. The skid steer rolling compactor attachment according to claim 9, further comprising:
a frame attached to the boom and configured to support the roller on a bearing; and
an adjustable scraper mounted to the frame and extending a length of the roller configured to scrape a debris off of the roller as the roller revolves about the bearing.

11. The skid steer rolling compactor attachment according to claim 9, further comprising:
a hydraulic lift cylinder attached to the attachment plate and the boom configured to lift and lower the boom about the lift hinge;
a hydraulic twist cylinder attached to the frame and the boom configured to twist the roller about the twist hinge;
a hydraulic tilt cylinder attached to the frame and the boom configured to tilt the roller about the tilt hinge; and a hydraulic pivot cylinder attached to the attachment plate and the boom configured to pivot the boom about the pivot hinge.

12. The skid steer rolling compactor attachment according to claim 10, further comprising:

a pair of side plates attached to the frame surrounding the roller; and a guide attached to each one of the side plates.

13. The skid steer rolling compactor attachment according to claim 11, wherein each one of the hydraulic cylinders of the rolling compactor attachment are configured to be remotely and hydraulically controlled from within a skid steer.

14. The skid steer rolling compactor attachment according to claim 10, wherein the frame is attached to a central axis of the roller.

15. A method of operating a skid steer comprising:

attaching a mounting plate to a skid steer;

attaching a boom to the mounting plate by way of a pivot hinge and a lift hinge;

attaching a frame to the boom opposite the mounting plate;

attaching a roller to the frame;

articulating the roller to a side of the skid steer;

lowering the roller to contact a sloped surface;

maintaining the skid steer on a level ground; and compacting the inclined sloped as the skid steer is driven on the level ground.

16. The method of operating a skid steer according to claim 15, further comprising pivoting the boom about the pivot hinge with a pivot cylinder operated from within the skid steer.

17. The method of operating a skid steer according to claim 15, further comprising lifting the boom about the lift hinge with a lift cylinder operated from within the skid steer.

18. The method of operating a skid steer according to claim 15, further comprising twisting the roller about a twist hinge with a twist cylinder operated from within the skid steer.

19. The method of operating a skid steer according to claim 15, further comprising tilting the roller about a tilt hinge with a tilt cylinder operated from within the skid steer.

20. The method of operating a skid steer according to claim 15, wherein attaching a roller to the frame comprises attaching the frame to a central axis of the roller.

* * * * *